US009847582B2

(12) United States Patent
Moulder et al.

(10) Patent No.: US 9,847,582 B2
(45) Date of Patent: Dec. 19, 2017

(54) WIDEBAND SIMULTANEOUS TRANSMIT AND RECEIVE (STAR) ANTENNA WITH MINIATURIZED TEM HORN ELEMENTS

(71) Applicants: William F. Moulder, Nashua, NH (US); Bradley T. Perry, Nashua, NH (US); Jeffrey S. Herd, Rowley, MA (US)

(72) Inventors: William F. Moulder, Nashua, NH (US); Bradley T. Perry, Nashua, NH (US); Jeffrey S. Herd, Rowley, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 526 days.

(21) Appl. No.: 14/483,516

(22) Filed: Sep. 11, 2014

(65) Prior Publication Data

US 2015/0145741 A1 May 28, 2015

Related U.S. Application Data

(60) Provisional application No. 61/908,476, filed on Nov. 25, 2013.

(51) Int. Cl.
*H01Q 13/02* (2006.01)
*H01Q 1/52* (2006.01)
(Continued)

(52) U.S. Cl.
CPC ..... *H01Q 13/02* (2013.01); *H01Q 1/525* (2013.01); *H01Q 5/40* (2015.01); *H01Q 9/28* (2013.01); *H01Q 21/205* (2013.01); *H01Q 21/28* (2013.01)

(58) Field of Classification Search
CPC ..... H01Q 13/02; H01Q 5/40; H01Q 1/525; H01Q 9/28; H01Q 21/205; H01Q 21/28
(Continued)

(56) References Cited

U.S. PATENT DOCUMENTS 5,325,105 A * 6/1994 Cermignani ..... H01Q 13/08 343/786
5,539,414 A 7/1996 Keen
(Continued)

FOREIGN PATENT DOCUMENTS

EP 1 863 122 A1 12/2007

OTHER PUBLICATIONS

Chung et al.; "Design of an Ultrawide-Band TEM Horn Antenna With a Microstrip-Type Balun;" IEEE Transactions on Antenna and Propagation, vol. 53, No. 10; Oct. 2005; pp. 3410-3413.
(Continued)

*Primary Examiner* — Jessica Han
*Assistant Examiner* — Bamidele A Jegede
(74) *Attorney, Agent, or Firm* — Daly, Crowley, Mofford & Durkee, LLP

(57) ABSTRACT

An antenna system capable of achieving simultaneous transmit and receive (STAR) operation over a wide bandwidth includes a ring array of TEM horn elements and a centrally located monocone or bicone antenna. The TEM horn elements each include a capacitive feed. The elements of the ring array are excited using a phasing scheme that results in signal cancellation at the location of the central element. The ring array may serve as either the transmit antenna or the receive antenna.

20 Claims, 9 Drawing Sheets

(51) Int. Cl.

| | |
|---|---|
| ***H01Q 9/28*** | (2006.01) |
| ***H01Q 21/20*** | (2006.01) |
| ***H01Q 21/28*** | (2006.01) |
| ***H01Q 5/40*** | (2015.01) |

(58) Field of Classification Search
USPC ..... 343/775
See application file for complete search history.

(56) References Cited

U.S. PATENT DOCUMENTS 5,838,282 A * 11/1998 Lalezari ..... H01Q 5/40 343/700 MS
5,959,591 A * 9/1999 Aurand ..... H01Q 13/08 343/753
6,075,495 A * 6/2000 Podgorski ..... G01R 29/0821 343/776
6,147,657 A * 11/2000 Hildebrand ..... H01Q 21/205 343/844
6,980,167 B2 12/2005 Brachat et al.
7,498,989 B1 * 3/2009 Volman ..... H01Q 1/287 343/700 MS
8,164,533 B1 4/2012 Hsu et al.
8,174,533 B2 5/2012 Couvert et al.
8,749,441 B2 6/2014 Fenn et al.
2004/0150568 A1 * 8/2004 Chiang ..... H01Q 1/24 343/702
2005/0231436 A1 * 10/2005 McLean ..... H01Q 13/0275 343/786
2006/0284779 A1 * 12/2006 Parsche ..... H01Q 21/29 343/773
2013/0106667 A1 5/2013 Fenn et al.

OTHER PUBLICATIONS

Snow et al.; "Transmit-Receive Duplexing Using Digital Beamforcing System to Cancel Self-Interference:" IEEE Transactions on Microwave Theory and Techniques, vol. 59, No. 12; Dec. 2011; pp. 3494-3503.
Kolodziej, et al.; "Ring Antenna with Optimized Beamformer for Simultaneous Transmit and Receive;" IEEE International Symposim on Antennas and Propagation (APSURSI), Jul. 8-14, 2012; 2 pages.
Moulder, et al.; "Wideband Antenna Array for Simultaneous Transmit and Receive (STAR) Applications;" Massachusetts Institute of Technology Presentation; Jul. 7, 2014; 12 pages.
Mueller, et al.; "A UHF Ultrabroadband Vivaldi-Type Direction Finding Antenna;" IEEE International Symposium on Antennas and Propagation (APSURI); Jul. 11-17, 2010; 4 pages.
Wang, et al.; "TEM Horn Circular Array for Wide Band Pattern Notch Reconfigurable Antenna System;" IEEE 2010 Loughborough Antennas and Propagation Conference; Nov. 8-9, 2010; pp. 365-367.
PCT Search Report for PCT/US2014/55129 dated Dec. 15, 2014 3 pages.
PCT Written Opinion of the International Searching Authority for PCT/US2014/55129 dated Dec. 15, 2014 10 pages.

* cited by examiner

WIDEBAND SIMULTANEOUS TRANSMIT AND RECEIVE (STAR) ANTENNA WITH MINIATURIZED TEM HORN ELEMENTS

CROSS REFERENCE TO RELATED APPLICATION

The present application claims the benefit of U.S. Provisional Patent Application No. 61/908,476 filed on Nov. 25, 2013, winch is hereby incorporated by reference herein in its entirety.

GOVERNMENT RIGHTS

This invention was made with Government support under Contract No. FA8721-05-C-0002 awarded by the U.S. Air Force. The Government has certain rights in the invention.

FIELD

The subject matter described herein relates generally to antennas and, more particularly, to antennas that are capable of full duplex operation.

BACKGROUND

Simultaneous transmit, and receive (STAR) refers to the ability of a radio frequency (RF) circuit, device, or system to transmit and receive at the same time, in the same frequency band, with adequate performance in the receiver. Such capability is desired for applications such as, for example, cognitive radio and full-duplex communications systems. In a conventional approach, RF transmit and receive operations within a particular frequency band are performed at different times. This is because transmit energy from a transmit antenna will typically leak into the front end of a collocated receiver and overdrive the receiver if transmit and receive operations are performed concurrently. This transmitter leakage can mask the desired receive signals, thus making it difficult or impossible to detect, demodulate, and decode the signals. For STAR operation to be possible, therefore, a certain minimum level of isolation must be main tamed between a transmit antenna and a receive antenna.

Antennas have been designed in the past that are capable of supporting STAR operation. However, such antennas have invariably been of relatively low bandwidth. There is a need for antennas that are capable of simultaneous transmit and receive operation over wider bandwidths.

SUMMARY

Antenna structures and methods are described herein that are capable of simultaneous transmit and receive (STAR) operation, with high isolation between transmit and receive antennas, over relatively wide bandwidths. In at least one embodiment, a STAR antenna includes a ring array having an even number of transverse electromagnetic (TEM) horn elements spaced at equal angular intervals in a circular configuration. Opposing elements in the ring array are driven 180 degrees out of phase. In at least one implementation, the ring array includes 8 elements and the phasing of the elements is 0, 45, 90, 135, 180 225, 270, and 315 degrees, respectively, around the ring. The TEM horn elements in the array include capacitive feeds. The antenna also includes another antenna element that is centrally located with respect to the ring. The central element may include, for example, a mono-cone or bi-cone element. During operation, the ring array may operate as a transmit antenna and the central element may operate as a receive antenna. In an alternate approach, the central element may operate as the transmit antenna and the ring array may operate as the receive antenna.

In some embodiments, the elements of the ring array may include solid-metal TEM horn elements. As described above, these TEM horn elements may be capacitively fed. It was found that capacitive feeds could improve bandwidth considerably in the underlying antenna architecture, when using the corresponding excitation scheme, by improving the low frequency impedance match of the ring array elements. Because opposing elements in the ring array are excited 180 degrees out of phase, signals transmitted by opposing elements will substantially cancel at the location of the central element (i.e., zero sum interference from opposing elements). In at least one embodiment, the ring array is located between two metallic reflector structures with the elements of the ring oriented so that their corresponding directional beams point radially outward from the ring. The central element may be mounted above one of the two reflector structures, is a central location. The elements of the ring array may be fed from below by coaxial cables that couple to a capacitor associated with each corresponding horn. A coaxial feed may also extend up through the center of the ring array to feed the central element at the top of the antenna.

In accordance with the concepts, systems, circuits, and techniques described herein, an antenna system for simultaneous transmit and receive (STAR) comprises a ring array having an even number (N) of TEM horn elements arranged in a circular configuration on a horizontal plane, where each of the TEM horn antennas includes a capacitive feed, and a center element substantially centered on a vertical axis that extends through a center point of the ring array. The center element may include either a monocone element or a bicone element.

In one embodiment, the antenna system may further include circuitry for exciting the TEM horn elements of the ring array such that opposing elements in the ring array are phased at a 180 degree phase difference and adjacent elements in the ring array are phased at a 360/N phase difference.

In one embodiment, the ring array is a transmit antenna and the center element is a receive antenna.

In one embodiment, the ring array is a receive antenna and the center element is a transmit antenna.

In one embodiment, the ring array includes at least one solid-metal TEM horn element.

In one embodiment, all elements of the ring array include solid-metal TEM horn elements.

In one embodiment, the antenna system achieves at least 40 dB of isolation between a transmit antenna and a receive antenna over at least a 6:1 bandwidth.

In one embodiment, the TEM horn elements of the ring array are miniaturized by exploiting mutual coupling between the elements of the ring array.

In one embodiment a largest dimension of each of the TEM horn elements of the ring array is approximately 0.17 wavelengths at the lowest operational frequency of the antenna system.

In one embodiment, the antenna system further comprises upper and lower reflectors each having a truncated cone shape, wherein the ring array is disposed within a region between the upper and lower reflectors.

In one embodiment, the TEM horns of the ring array are mounted within a depression in an upper surface of the lower reflector; and the upper and lower reflectors are spaced from one another using dielectric spacers.

In one embodiment, the center element is mounted above the upper reflector and is fed by a coaxial feed extending through fee center of the ring array.

In one embodiment, the TEM horns of the ring array are oriented so that directional beams associated with the horns are directed radially outward from the ring array.

In one embodiment, the ring array includes a first TEM horn element having a substantially vertical metallic surface at an end thereof closest to the center point of the ring array, wherein the capacitive feed associated with the first TEM horn element includes a parallel plate capacitor disposed against the substantially vertical metallic surface.

In one embodiment the parallel plate capacitor includes a circuit board having metallization on at least one surface thereof.

In one embodiment, the capacitive feed associated with the first TEM horn element further includes a coaxial transmission line having a center conductor conductively coupled to metallization on the circuit board.

BRIEF DESCRIPTION OF THE DRAWINGS

The foregoing features may be more folly understood from the following description of the drawings in which.

DETAILED DESCRIPTION

Figure 1:
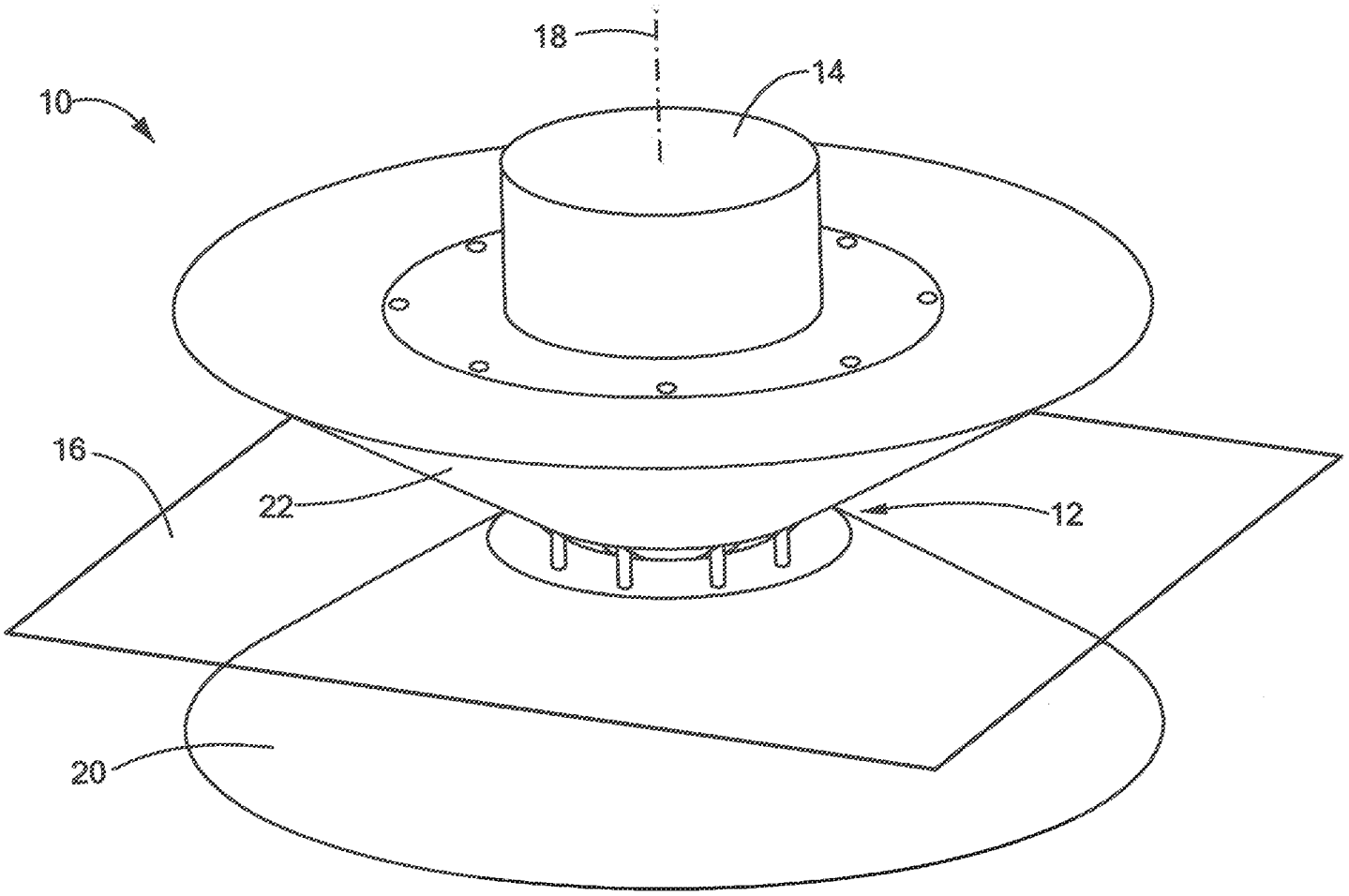
FIG. 1 is a diagram illustrating an exemplary STAR antenna having a ring array of TEM horn elements and a monocone center element in accordance with an embodiment.

FIG. 1 is a diagram illustrating an exemplary STAR antenna 10 in accordance with, an embodiment. As will be described in greater detail, the antenna 10 includes a ring array of transverse electromagnetic (TEM) horn elements 12 and a centrally located monocone or bicone element 14 (shown with a radome in FIG. 1). The ring array 12 may lie within a horizontal plane 16 extending through the antenna 10. In the illustrated embodiment, the ring array 12 is disposed between a lower reflector 20 and an upper reflector 22. The lower and upper reflectors 20, 22 may each have a truncated cone shape or similar shape that provides a gradually increasing distance between conductive surfaces with increasing radial distance from the ring array. The central element 14 may be located above the ring array 12 and may be substantially centered on a vertical axis 18 that extends through a center of the ring array 12. In the illustrated embodiment, the central element 14 is located above the upper reflector 22 on a flat upper surface thereof. The STAR antenna 10 may be operated with either the ring array 12 or the center element 14 as the transmit antenna. In either case, the other antenna will operate as the receive antenna.

A design goal for the antenna 10 of FIG. 1 was to achieve wide bandwidth with an omnidirectional (or near omnidirectional) antenna pattern in the azimuth plane. It was also desired to reduce pattern ripple at the high end of the frequency band, where ripple is typically more prevalent. It was determined that the ripple could be reduced by designing a ring array with a relatively small radius. However, as is well known, a reduction in ring radius can negatively affect operation at lower frequencies. The challenge, therefore, was to achieve wide bandwidth while maintaining low pattern ripple at the high end of the band. It was determined that ring size could be reduced by exploiting mutual coupling between the TEM horn elements of the ring array to permit a miniaturized array to be achieved. It was further determined that capacitive feeds could be used with the TEM horn elements of the ring array to improve low frequency match for the elements, when excited with fee desired excitation scheme, in a manner that maintains wide bandwidth operation. Using this approach, STAR antennas have been achieved mat are capable of maintaining 46 dB or more of isolation between transmit and receive antennas over a 8:1 or larger bandwidth.

Figure 2:
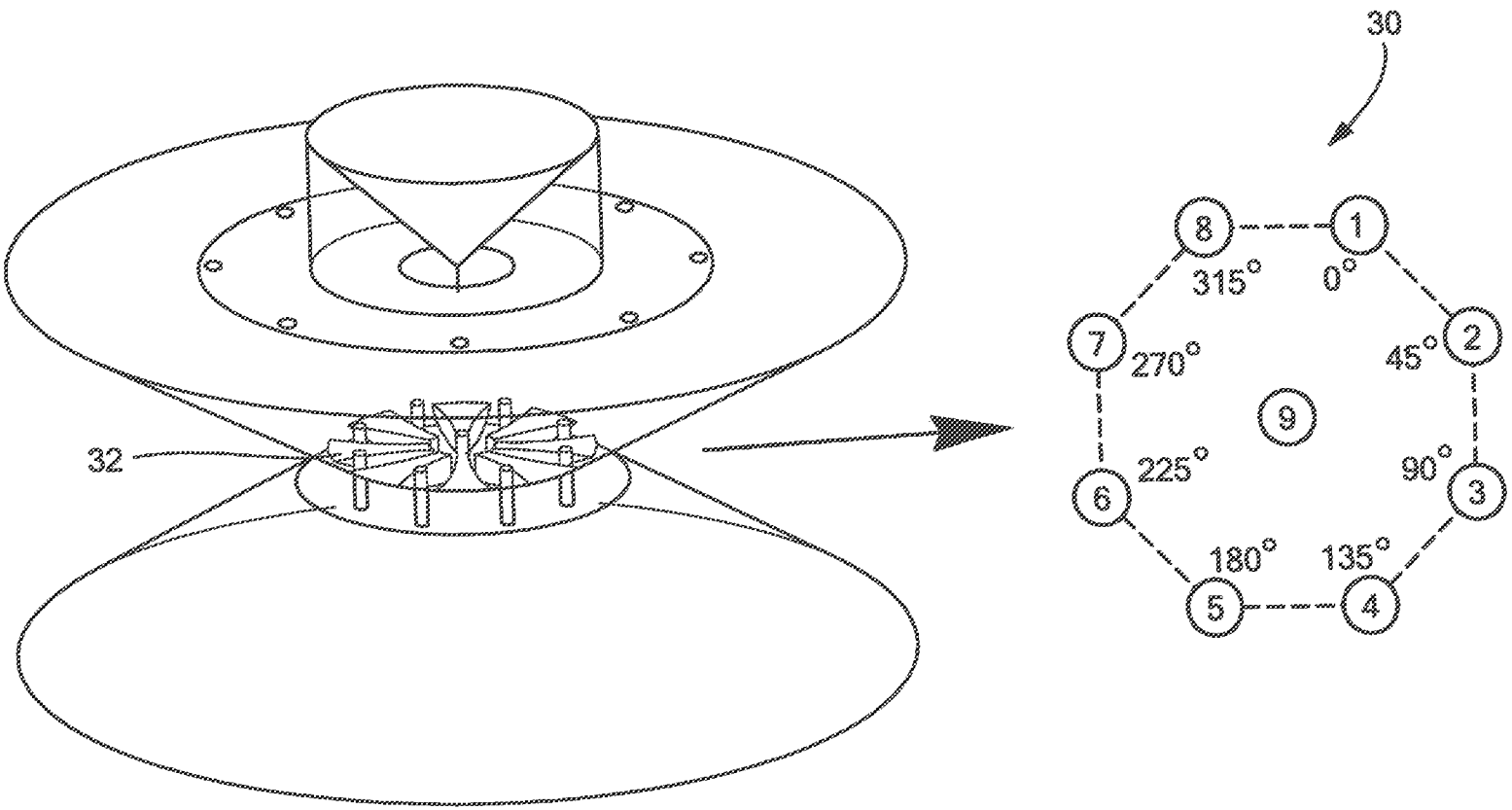
FIG. 2 is a diagram illustrating an exemplary excitation scheme that may be used for the elements of a ring array of a STAR antenna in accordance with an embodiment.

FIG. 2 is a diagram illustrating an exemplary phasing scheme 30 that may be used to excite the elements of a ring array of a STAR antenna in accordance with an embodiment. As shown, a ring array 32 may be provided having 8 TEM horn elements distributed in a circular configuration with equal angular displacement between elements. The elements of the ring array may be phased such that opposing elements in the array are phased 180 degrees ($\pi$ radians) out of phase. In addition, the elements in the ring array may be progressively phased about the ring so that each pair of adjacent elements in the array are excited 45 degrees out of phase. Thus, the elements of the array may be respectively phased at 0, 45, 90, 135, 180, 225, 270, and 315 degrees, respectively. This is a first order circular phasing mode that results in a quasi-omnidirectional far field pattern.

Because opposing elements in the array are fed in anti-phase (i.e., 180 degrees out-of-phase), corresponding radiated fields cancel at the central element, resulting in high isolation between the ring array and the central element. In some embodiments, circuitry may be provided within the antenna that is capable of maintaining the excitation scheme 30 of FIG. 2 (and the corresponding isolation) over a wide operational bandwidth. In at least one approach, a network of high-bandwidth hybrid couplers may be used to provide the phasing. Although illustrated with 8 elements in FIG. 2, it should be appreciated that the ring array need only include an even number (N) of elements in other implementations. In these implementations, opposing elements will also be fed in anti-phase and adjacent elements may be fed at a phase difference of 360/N degrees.

Figure 3:
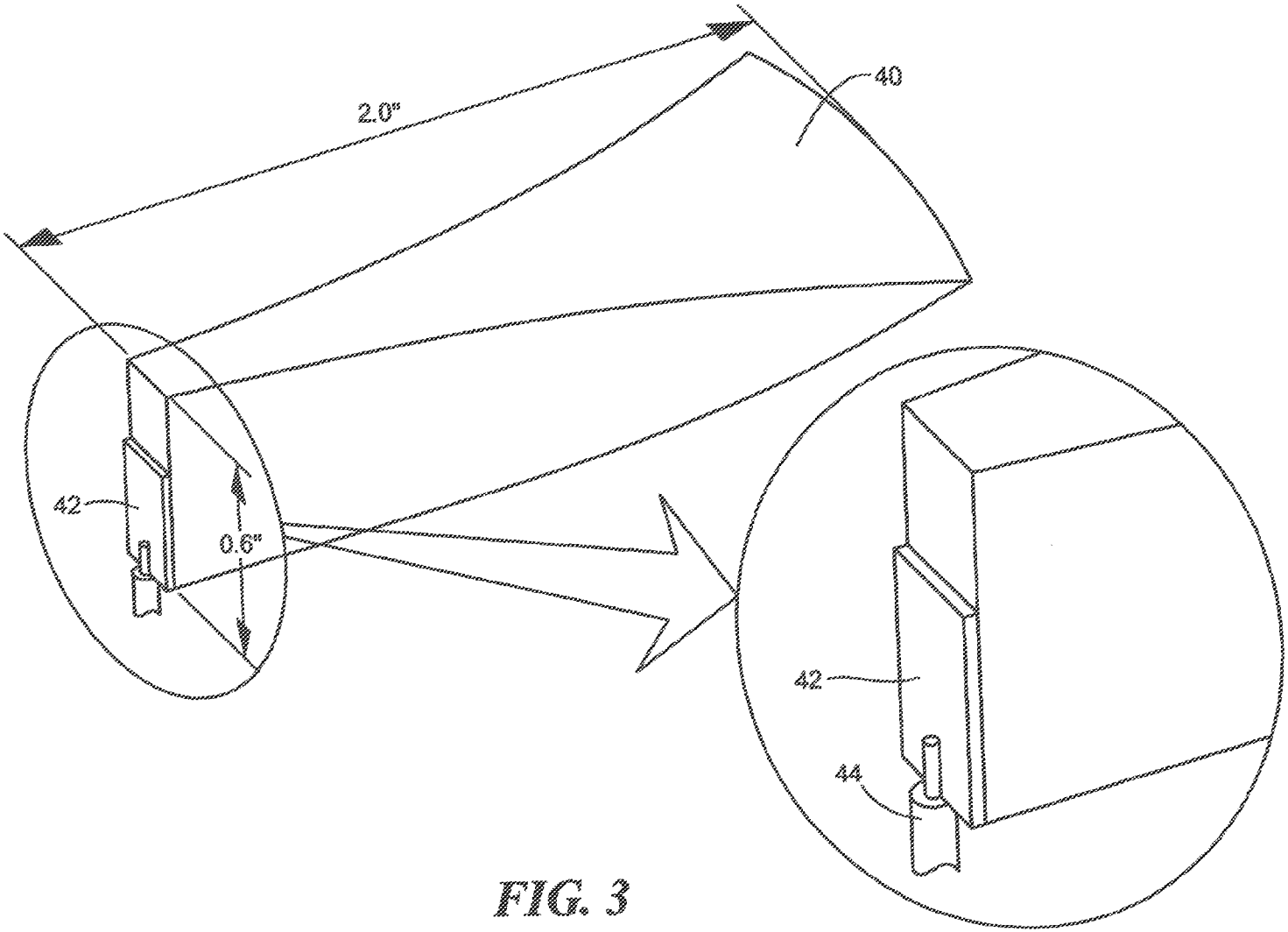
FIG. 3 is a diagram illustrating an exemplary solid-metal TEM horn element that may be used within a ring array of a STAR antenna in accordance with an embodiment.

FIG. 3 is a diagram illustrating an exemplary solid-metal TEM horn element 40 that may be used within a ring array of a STAR antenna in accordance with an embodiment. Although TEM horn elements are widely used as wideband radiators, the version depicted in FIG. 3 is unique in at least the following respects: 1) it employs a capacitive feed 42 for improvement of impedance matching at the low end of its operational hand; 2) it exploits mutual coupling within a closely spaced ring array (depicted in FIG. 4) for improved bandwidth; 3) its construction is solid (rather than hollow, like a conventional TEM horn), for improved bandwidth and durability. As shown in FIG. 3, the TEM horn element 40 includes a capacitive feed 42. The capacitive feed 42 may include a parallel plate capacitor that is driven by a coaxial transmission line in some implementations. The parallel plate capacitor may be coupled to an end surface of the TEM horn element 40 that will be located toward a center of the ring array. In a low cost approach, the parallel plate capacitor may be realized using a circuit board material having metallization on one or both surfaces thereof. The center conductor of a coaxial cable or coaxial connector may be conductively coupled to the metallization on one side of the circuit hoard which serves as one plate of the capacitor. The end surface of the TEM horn element or metallization on the other side of the circuit hoard may form the other plate of the capacitor. It was determined that the use of such capacitive feeds with the TEM horn elements of the ring array can provide an impedance match at the low end of the desired operational frequency band of the antenna system to allow broad bandwidths to be achieved with reduced ring sizes.

Figure 7:
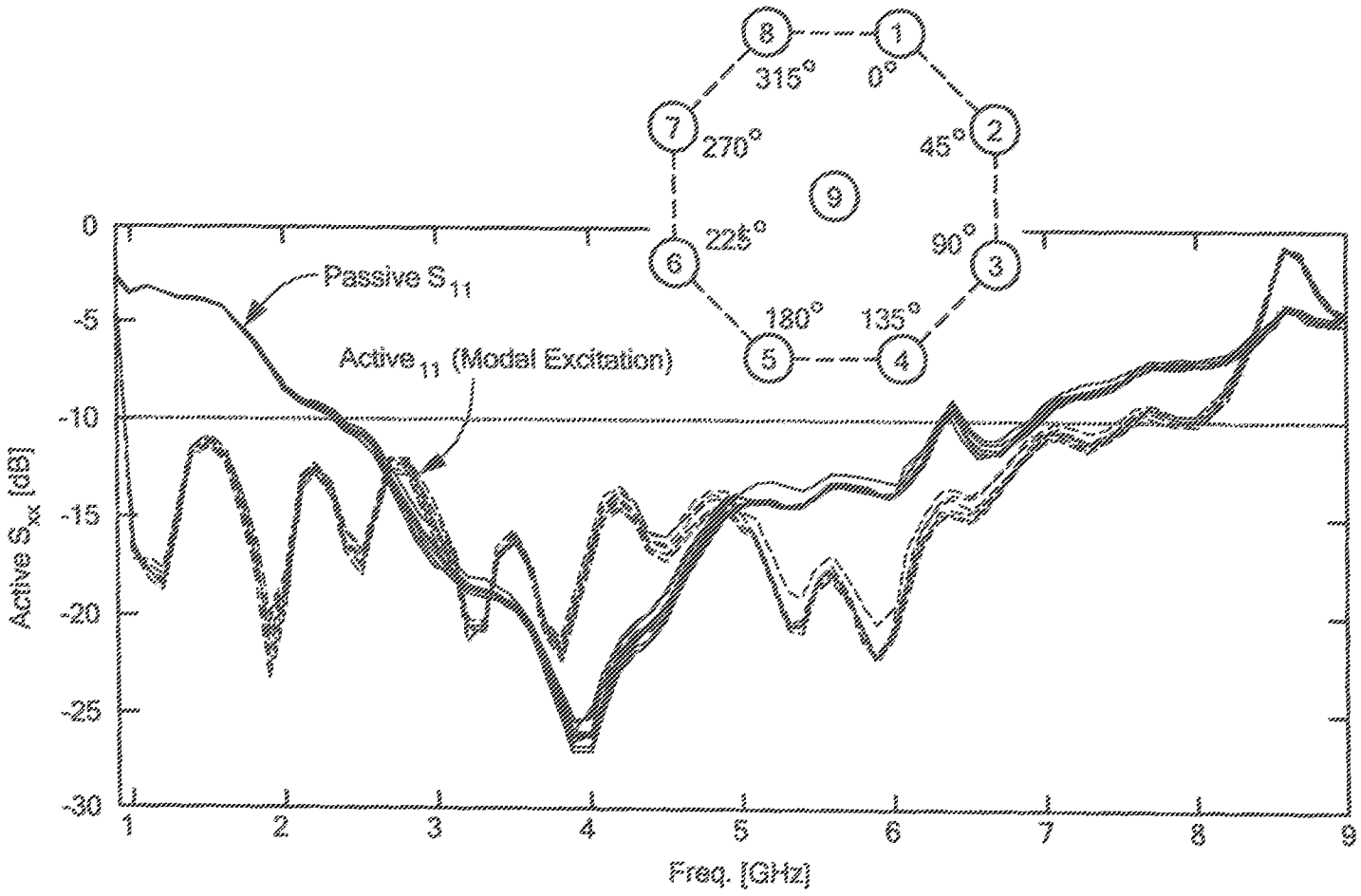
FIG. 7 is a plot illustrating both active input match versos frequency of the ring array elements of a STAR antenna under modal excitation and corresponding passive input match versus frequency for the same elements.

As described previously, mutual coupling between adjacent elements in the ring array may be exploited to reduce the size of the TEM horn element 40 (i.e., the element and the array may be miniaturized). This is evident in the curves provided in FIG. 7. As seen, the plot compares the passive matching response of a TEM horn element (e.g., reflection coefficient of the element with no other array elements excited) with its active matching response (e.g., reflection coefficient of element with fell array excited as shown in FIG. 7 inset). As seen, the responses are quite different at the low end of the operational band, showing that the mutual coupling is quite significant. Further, the active response provides much better matching at the band's low end, showing the exploitation of the coupling for improved performance. This effect is due to the fact that excitation from one element is coupled to several other elements, increasing its effective electrical size at the low end. In one embodiment, at the lowest frequency of operation, the TEM horn element is approximately 0.17 wavelengths long. As shown in FIG. 3, in one embodiment, the solid-metal TEM horn element 40 may have a length of 2.0 inches and a height of 0.6 inches. This element is capable of achieving an operational bandwidth from 1-8 GHz in a STAR antenna. Similar bandwidth ratios may be achieved at other frequencies through scaling.

Figure 4:
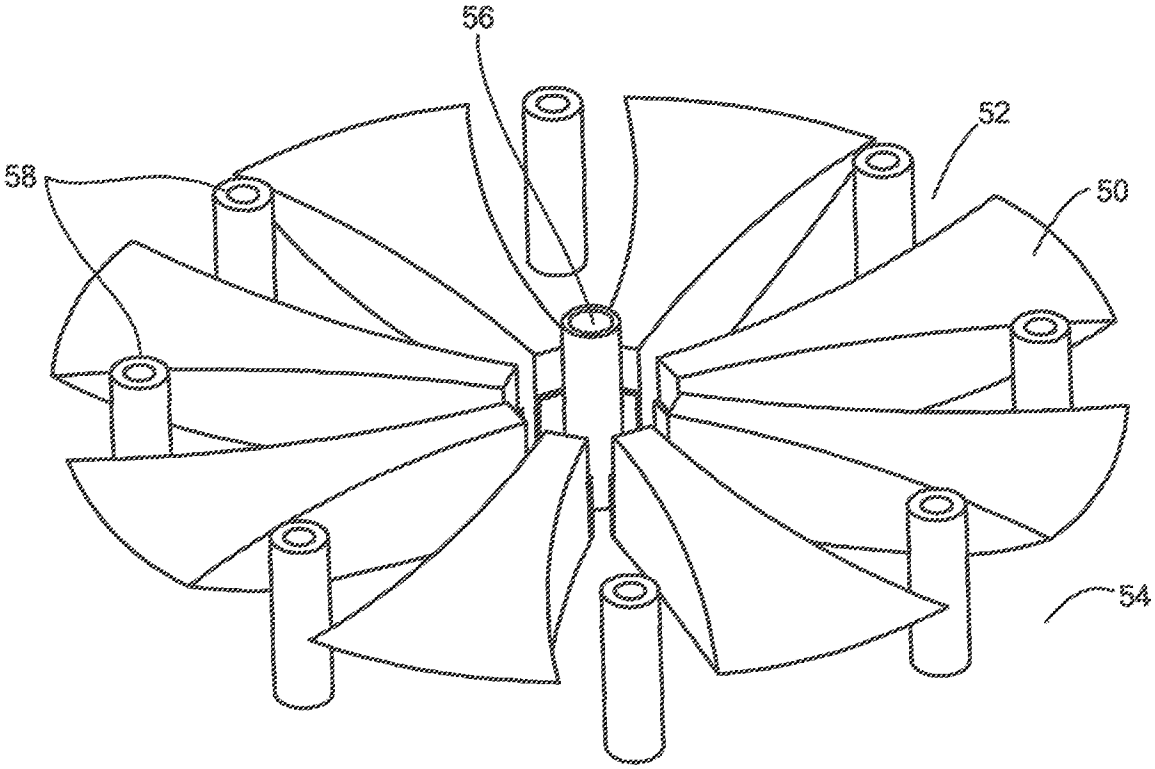
FIG. 4 is a diagram illustrating an arrangement for mounting TEM horn elements in a ring array of a STAR antenna in accordance with an embodiment.

FIG. 4 is a diagram illustrating an arrangement for mounting solid-metal TEM horn elements 50 in a ring array of a STAR antenna in accordance with an embodiment. As illustrated, the TEM horn elements 50 may be mounted within a depression 52 in a lower reflector 54 of a STAR antenna. As described above, each of the elements 50 within the ring array may include a capacitive feed at an end thereof toward the center of the ring array. The capacitive feeds may be driven by coaxial lines extending through the lower reflector 54. A coaxial feed 56 may also extend through the lower reflector 54, the ring array, and an upper reflector (not shown in FIG. 4) to feed the center element (not shown in FIG. 4). As illustrated, a plurality of dielectric (e.g., nylon, etc.) supports 58 may be used to provide separation between the upper and lower reflectors of the antenna.

Figure 5:
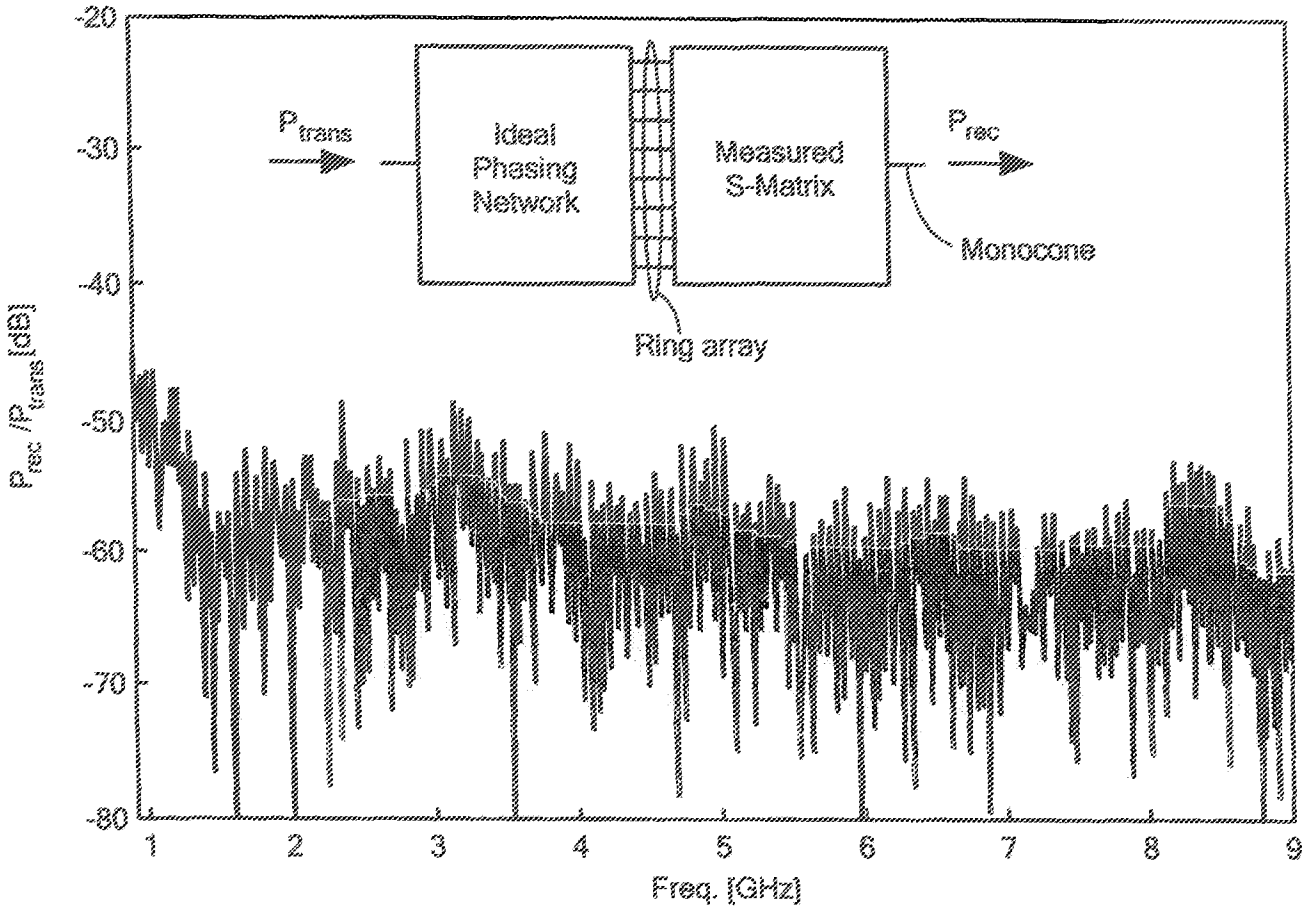
FIG. 5 is a plot of measured isolation versus frequency for an exemplary STAR antenna in accordance with an embodiment.
Figure 6:
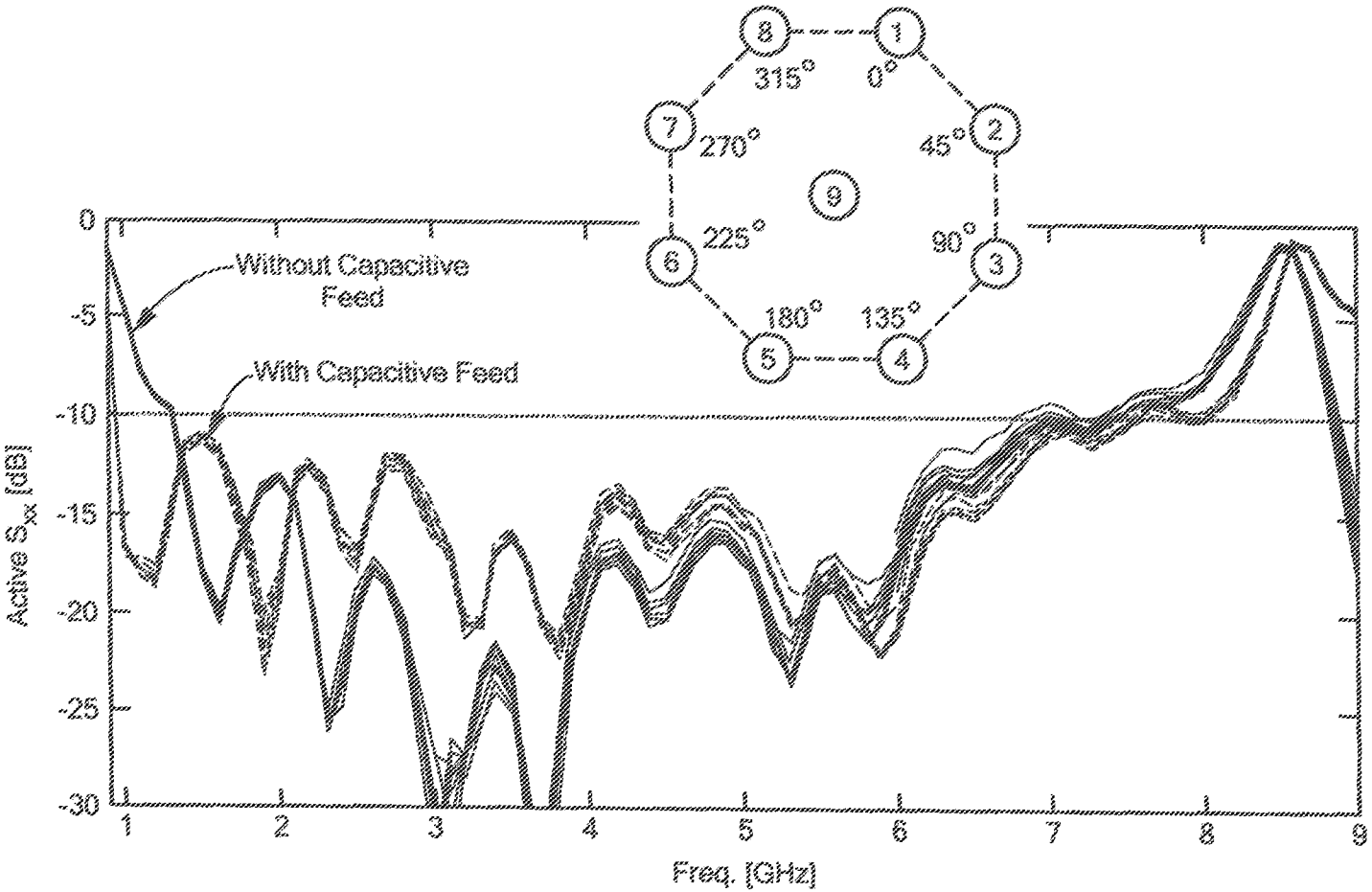
FIG. 6 is plot illustrating input match versus frequency for a TEM horn element of a ring array, both with and without a capacitive feed, for the excitation scheme of FIG. 2.
Figure 8A:
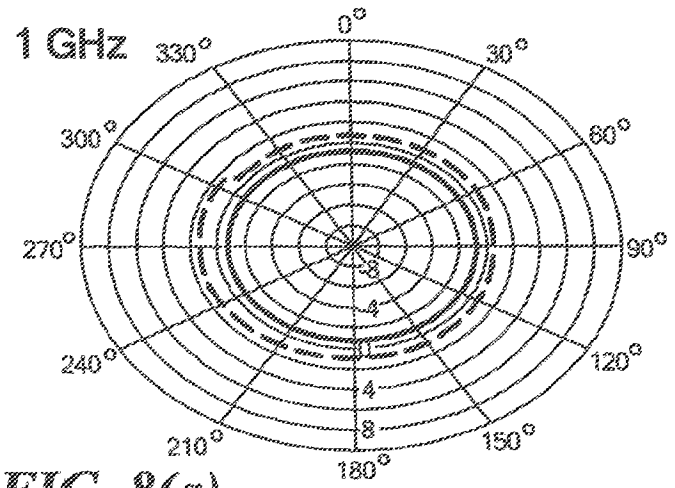
FIGS. 8*a*-8*d* are polar diagrams illustrating measured and simulated antenna patterns in azimuth, at various frequencies, for an exemplary STAR antenna in accordance with an embodiment.
Figure 8B:
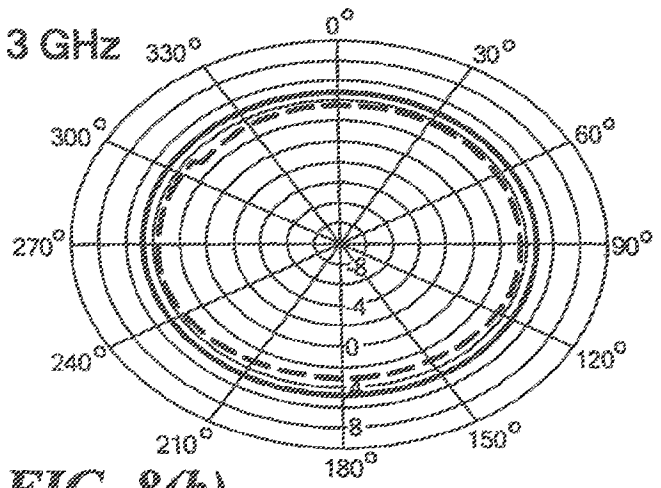
Figure 8C:
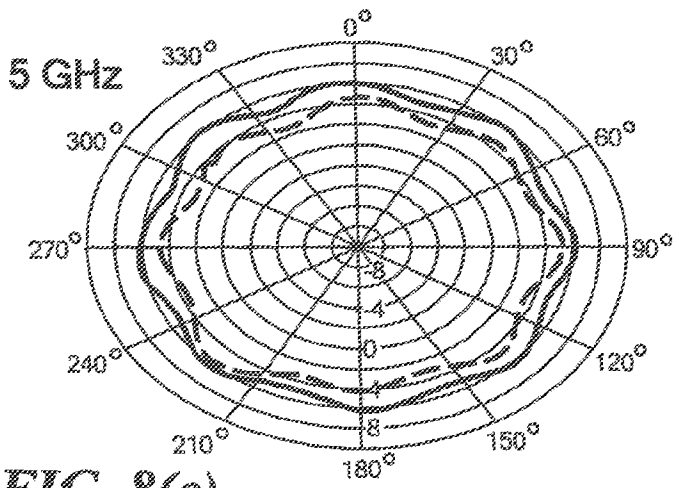
Figure 8D:
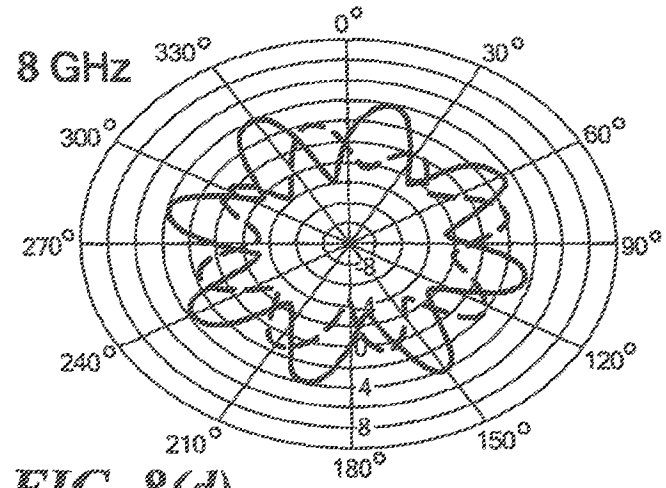

FIG. 5 is a plot of measured isolation ($P_{receive}/P_{transmit}$) versus frequency for an exemplary STAR antenna in accordance with an embodiment. As shown, the isolation remains below −46 dB across an entire frequency bandwidth from 1-8 GHz. For most of this bandwidth, the isolation, is below −50 dB. FIG. 6 is plot illustrating the input match $S_{xx}$ of the TEM horn elements of the ring array versus frequency, both with and without the capacitive feed, for the modal excitation scheme of FIG. 2. As shown, the capacitive feed extends the low frequency match of the ring elements to below 1 GHz for this element excitation. FIG. 7 is a plot illustrating the active input match $S_{11}$ versus frequency of the ring array elements under modal excitation and the corresponding passive input match $S_{11}$. As shown, the match under modal excitation extends much lower in frequency than the corresponding passive match. FIGS. 8*a*-8*d* are polar diagrams illustrating the measured and simulated antenna patterns in azimuth of an exemplary STAR antenna in accordance with an invention, at multiple frequencies. The simulated pattern is shown with a solid line and the measured pattern is shown with a dotted line. FIG. 8*a* shows the pattern at 1 GHz, FIG. 8*b* shows the pattern at 3 GHz, FIG. 8*c* shows die pattern at 5 GHz, and FIG. 8*d* shows the pattern at 8 GHz. As illustrated, the gain ripple of the antenna in azimuth increases with increasing frequency. Because a reduced ring size was used in this embodiment, the ripple in gain is adequately low well past 5 GHz operation.

Figure 9:
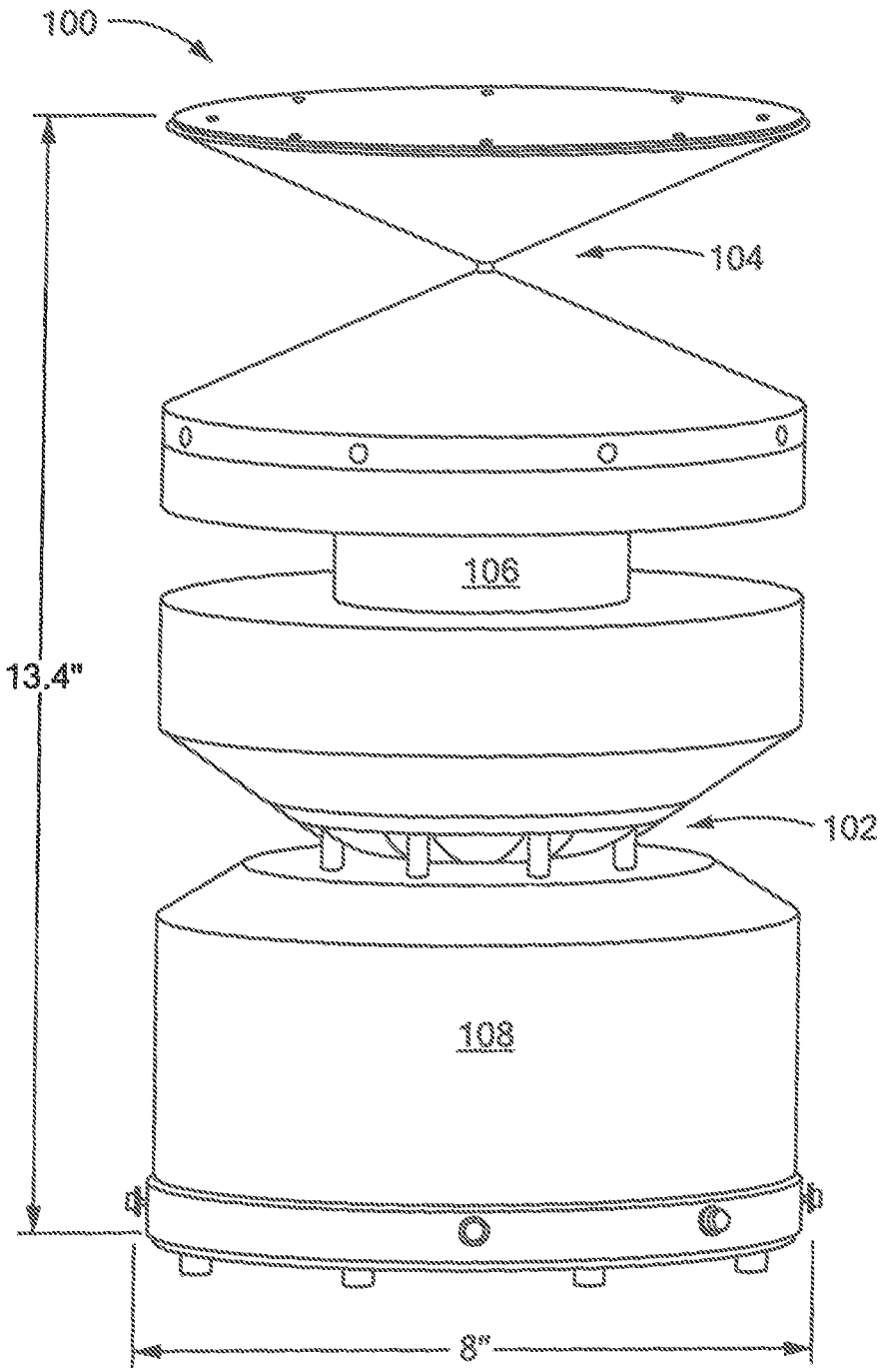
FIG. 9 is a diagram illustrating another exemplary STAR antenna having a ring array of TEM horn elements and a bicone center element in accordance with an embodiment.

FIG. 9 is a diagram illustrating another exemplary STAR antenna 100 in accordance with an embodiment. As shown, the antenna 100 includes a ring array 102 of TEM horn elements and a centrally located bicone element 104. The ring array 102 may be similar to those discussed previously. In at least one embodiment, the ring array may include 8 solid-metal TEM ring elements and fee excitation scheme illustrated in FIG. 2 may be used. The bicone 104 is mounted above the ring array 102 and may be substantially centered on a vertical axis that extends through a center of the ring array. Although not shown, a radome may be used to protect the bicone 104 in some embodiments. Unlike the embodiment of FIG. 1, the antenna 100 of FIG. 9 also includes a choke ring 106 between the ring array 102 and the center element 104 to provide additional transmit/receive isolation. The antenna 100 of FIG. 9 also includes an additional compartment 108 within which circuitry may be located for appropriately phasing the elements of the array. This circuitry may include, for example, integrated hybrid couplers (e.g., 180 degree hybrids, etc.) and/or other circuitry.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. An antenna system for simultaneous transmit and receive (STAR), comprising:

a ring array having an even number (N) of TEM horn elements arranged in a circular configuration on a horizontal plane, each of the TEM horn antennas including a capacitive feed; and a center element substantially centered on a vertical axis that extends through a center point of the ring array, wherein the center element includes one of a monocone element or a bicone element, wherein the ring array includes a first TEM horn element having a substantially vertical metallic surface at an end thereof closest to the center point of the ring array, wherein the capacitive feed associated with the first TEM horn element includes a parallel plate capacitor disposed against the substantially vertical metallic surface.

2. The antenna system of claim 1, further comprising: circuitry for exciting the TEM horn elements of the ring array such that opposing elements in the ring array are phased at a 180 degree phase difference and adjacent elements in the ring array are phased at a 360/N phase difference.

3. The antenna system of claim 1, wherein:

the ring array is a transmit antenna and the center element is a receive antenna.

4. The antenna system of claim 1, wherein:

the ring array is a receive antenna and the center element is a transmit antenna.

5. The antenna system of claim 1, wherein:

the ring array includes at least one solid metal TEM horn element.

6. The antenna system of claim 1, wherein:

all elements of the ring array include solid metal TEM horn elements.

7. The antenna system of claim 1, wherein:

the antenna system achieves at least 40 dB of isolation between simultaneous transmit and receive operation over at least a 6:1 bandwidth.

8. The antenna system of claim 1, wherein:

a largest dimension of each of the TEM horn elements of the ring array is less than 0.17 wavelengths at the lowest operating frequency of the antenna system.

9. The antenna system of claim 1, wherein:

the small size of the TEM horn elements of the ring array is achieved by exploiting mutual coupling between the elements of the ring array.

10. The antenna system of claim 1, further comprising:

upper and lower reflectors each having a truncated cone shape, wherein the ring array is disposed within a region between the upper and lower reflectors.

11. The antenna system of claim 10, wherein:

the TEM horns of the ring array are mounted within a depression in an upper surface of the lower reflector; and the upper and lower reflectors are spaced from one another using dielectric spacers.

12. The antenna system of claim 10, wherein:

the center element is mounted above the upper reflector and is fed by a coaxial feed extending through the center of the ring array.

13. The antenna system of claim 1, wherein:

the TEM horns of the ring array are oriented so that beams associated with the elements are directed radially outward from the ring array.

14. The antenna system of claim 1, wherein:

the parallel plate capacitor includes a circuit board material having metallization on at least one surface thereof.

15. The antenna system of claim 14, wherein:

the capacitive feed associated with the first TEM horn element further includes a coaxial transmission line having a center conductor conductively coupled to metallization on the circuit board.

16. An antenna system for simultaneous transmit and receive (STAR), comprising:

a ring array having an even number (N) of transverse electromagnetic (TEM) horn elements arranged in a circular configuration on a horizontal plane wherein the ring array includes a first TEM horn element having a substantially vertical conductive surface at an end thereof closest to a center point of the ring array;

a center element substantially centered on a vertical axis that extends through a center point of the ring array, wherein the center element includes one of a monocone element or a bicone element;

a capacitive feed coupled to a first one of the TEM horn antennas in the ring array wherein the capacitive feed associated with the first TEM horn element comprises a parallel plate capacitor disposed against the substantially vertical conductive surface of the first TEM horn element.

17. The antenna system of claim 16, wherein:

each TEM horn element has a substantially vertical conductive surface at an end thereof closest to a center point of the ring array;

the capacitive feed is a first one of a plurality of capacitive feeds, each of the plurality of capacitive feeds coupled to a corresponding one of the TEM horn antennas in the ring array; and each capacitive feed comprises a parallel plate capacitor disposed against the substantially vertical conductive surface of the corresponding TEM horn element.

18. The antenna system of claim 16, wherein the first one of the TEM horn antennas in the ring array ring is provided as a solid metal TEM horn element.

19. The antenna system of claim 16, wherein the parallel plate capacitor comprises a circuit board having a conductive surface.

20. The antenna system of claim 19, wherein the capacitive feed associated with the first TEM horn element further comprises a coaxial transmission line having a center conductor conductively coupled to the conductive surface of the circuit board.

* * * * *